US011263950B2

(12) United States Patent
Bae et al.

(10) Patent No.: US 11,263,950 B2
(45) Date of Patent: Mar. 1, 2022

(54) DISPLAY DEVICE HAVING MEMORY STORING IMAGE DATA AND DRIVING METHOD THEREOF

(71) Applicant: Samsung Display Co., Ltd., Yongin-si (KR)

(72) Inventors: Bong Ho Bae, Yongin-si (KR); Jong Gil Kim, Yongin-si (KR); Moon Sang Hwang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/736,707

(22) Filed: Jan. 7, 2020

(65) Prior Publication Data

US 2020/0265768 A1 Aug. 20, 2020

(30) Foreign Application Priority Data

Feb. 19, 2019 (KR) ..... 10-2019-0019228

(51) Int. Cl.
*G09G 3/20* (2006.01)

(52) U.S. Cl.
CPC ..... *G09G 3/2003* (2013.01); *G09G 3/2007* (2013.01); *G09G 2310/0267* (2013.01); *G09G 2310/08* (2013.01); *G09G 2320/0686* (2013.01)

(58) Field of Classification Search
CPC .. G09G 3/2003; G09G 3/2007; G09G 3/2074; G09G 3/2092; G09G 3/2096; G09G 3/3275–3291; G09G 3/3685–3696; G09G 5/005; G09G 5/02–06; G09G 5/42; G09G 2310/0267; G09G 2310/027; G09G 2310/04; G09G 2310/08; G09G 2320/0271; G09G 2320/0666; G09G 2320/0686; G09G 2340/06; G09G 2340/08
See application file for complete search history.

(56) References Cited

U.S. PATENT DOCUMENTS 6,831,617 B1 * 12/2004 Miyauchi ..... G09G 3/3666 345/1.3
9,030,454 B2 5/2015 Lee et al.
9,070,332 B2 6/2015 Kim et al.
10,043,492 B2 8/2018 Woo et al.
2017/0025055 A1 * 1/2017 Kim ..... G09G 3/2003
(Continued)

FOREIGN PATENT DOCUMENTS

KR 10-2016-0130628 A 11/2016
KR 10-2018-0035978 A 4/2018
(Continued)

*Primary Examiner* — Nathan Danielsen
(74) *Attorney, Agent, or Firm* — Lewis Roca Rothgerber Christie LLP

(57) ABSTRACT

A display device includes: an image display having at least one first display area and a second display area; a memory configured to store image data; and a timing controller configured to store first image data for the first display area in the memory after first image data for the first display area and the second display area is received from a host device, wherein the timing controller is configured to control the image display unit so as to display a first image in the first display area by loading the first image data for the first display area from the memory and to display a preset second image in the second display area.

12 Claims, 9 Drawing Sheets

(56) References Cited

U.S. PATENT DOCUMENTS

| | | | |
|---|---|---|---|
| 2018/0088892 | A1 | 3/2018 | Park |
| 2018/0240260 | A1 | 8/2018 | Lee et al. |

FOREIGN PATENT DOCUMENTS

| | | | |
|---|---|---|---|
| KR | 10-2018-0095409 | A | 8/2018 |
| KR | 10-1905779 | B1 | 10/2018 |
| KR | 10-1909675 | B1 | 10/2018 |

* cited by examiner

DISPLAY DEVICE HAVING MEMORY STORING IMAGE DATA AND DRIVING METHOD THEREOF

CROSS-REFERENCE TO RELATED APPLICATION

This application claims priority to and the benefit of Korean patent application number 10-2019-0019228 filed on Feb. 19, 2019, the entire disclosure of which is incorporated herein in its entirety by reference.

BACKGROUND

1. Field

Aspects of some example embodiments of the present disclosure relate to a display device and a driving method thereof.

2. Description of the Related Art

These days, various types of display devices, such as organic light-emitting display devices, liquid crystal display devices, plasma display devices, and the like, are widely being used.

In order to display video, such display devices periodically receive image data from an external host device or external source and display the same. Here, the display devices are configured to receive image data from the host device once, store the received image data in the internal storage space thereof, and periodically load and display the image data.

In order for a display device to store image data, a storage space having a capacity that is sufficient to store image data corresponding to full screen resolution is required. An increase in the capacity of the storage space in the display device may result in an increase in the overall size of the display device and an increase in the price thereof.

The above information disclosed in this Background section is only for enhancement of understanding of the background and therefore it may contain information that does not constitute prior art.

SUMMARY

Aspects of some example embodiments of the present disclosure are directed to a display device and a driving method thereof that may minimize or reduce the capacity of a storage space utilized for a display device to store image data.

Furthermore, aspects of some example embodiments of the present disclosure are directed to a display device and a driving method thereof through which image data only for a specific area, which is periodically updated in an image, is stored and an image for a full screen is displayed using the stored image data.

Furthermore, aspects of some example embodiments of the present disclosure are directed to a display device and a driving method thereof through which image data for a specific area is downscaled and is then stored and through which the stored image data is upscaled and is then displayed.

According to some example of the present disclosure, a display device includes: an image display unit having at least one first display area and a second display area, memory configured to store image data, and a timing controller configured to store first image data for the first display area in the memory when first image data for the first display area and the second display area is received from a host device, wherein the timing controller may control the image display unit so as to display a first image in the first display area by loading the first image data for the first display area from the memory and to display a preset second image in the second display area.

According to some example embodiments, the timing controller may store the first image data for an enabled first display area, among the at least one first display area, in the memory based on enabling information received from the host device.

According to some example embodiments, the timing controller may store the RGB values of the first image data in the memory.

According to some example embodiments, the timing controller may convert the RGB values of the first image data of the first display area into a single grayscale value and store the grayscale value in the memory.

According to some example embodiments, the timing controller may downscale the n-bit RGB values of the first image data of the first display area or an n-bit grayscale value, which is converted from the RGB values, to m-bit data and store the downscaled first image data in the memory, n being a natural number that is greater than 2 and m being a natural number that ranges from 1 to n−1.

According to some example embodiments, the timing controller may generate second image data by upscaling the downscaled first image data to n-bit data and display the first image in the first display area so as to correspond to the second image data.

According to some example embodiments, the timing controller may generate the second image data by adding n-m bits to the downscaled first image data, wherein all of the n-m bits may be '0's or '1's.

According to some example embodiments, when the n-bit grayscale value, which is converted from the RGB values, is downscaled to the m-bit data and is then stored in the memory, the timing controller may determine a color, which is preset to correspond to the downscaled first image data, and generate n-bit second image data corresponding to the determined color, m being a natural number that ranges from 1 to n−1.

According to some example embodiments, when the first image data is downscaled to 1-bit data and is then stored in the memory, the timing controller may determine a grayscale, which is preset to correspond to the downscaled first image data, and generate n-bit second image data corresponding to the determined grayscale.

According to some example embodiments, the second image may be a black image.

According to some example embodiments of the present disclosure, in a driving method of a display device, the driving method includes: receiving a control signal and first image data for at least one first display area and a second display area from a host device; storing first image data for the first display area; and displaying a first image in the first display area by loading the first image data and displaying a preset second image in the second display area.

According to some example embodiments, storing the first image data for the first display area may include determining an enabled first display area, among the at least one first display area, based on the enabling information of the control signal; and storing the first image data for the enabled first display area.

According to some example embodiments, storing the first image data for the first display area may include storing the RGB values of the first image data.

According to some example embodiments, storing the first image data for the first display area may include converting the RGB values of the first image data into a single grayscale value; and storing the first image data that is converted into the grayscale value.

According to some example embodiments, storing the first image data for the first display area may include downscaling the n-bit RGB values of the first image data or an n-bit grayscale value, which is converted from the RGB values, to m-bit data, n being a natural number that is greater than 2 and m being a natural number that ranges from 1 to n−1; and storing the downscaled first image data.

According to some example embodiments, displaying the first image in the first display area by loading the first image data and displaying the preset second image in the second display area may include generating second image data by upscaling the downscaled first image data to n-bit data; and displaying the first image in the first display area so as to correspond to the second image data.

According to some example embodiments, generating the second image data may include adding n-m bits to the downscaled first image data, wherein all of the n-m bits may be '0's or '1's.

According to some example embodiments, generating the second image data may include, when the n-bit grayscale value, which is converted from the RGB values, is downscaled to the m-bit data and is then stored, determining a color, which is preset to correspond to the downscaled first image data, m being a natural number that ranges from 1 to n−1; and generating n-bit second image data corresponding to the determined color.

According to some example embodiments, generating the second image data may include, when the first image data is downscaled to 1-bit data and is then stored, determining a grayscale, which is preset to correspond to the downscaled first image data; and generating n-bit second image data corresponding to the determined grayscale.

According to some example embodiments, the second image may be a black image.

DETAILED DESCRIPTION

Figure 1:
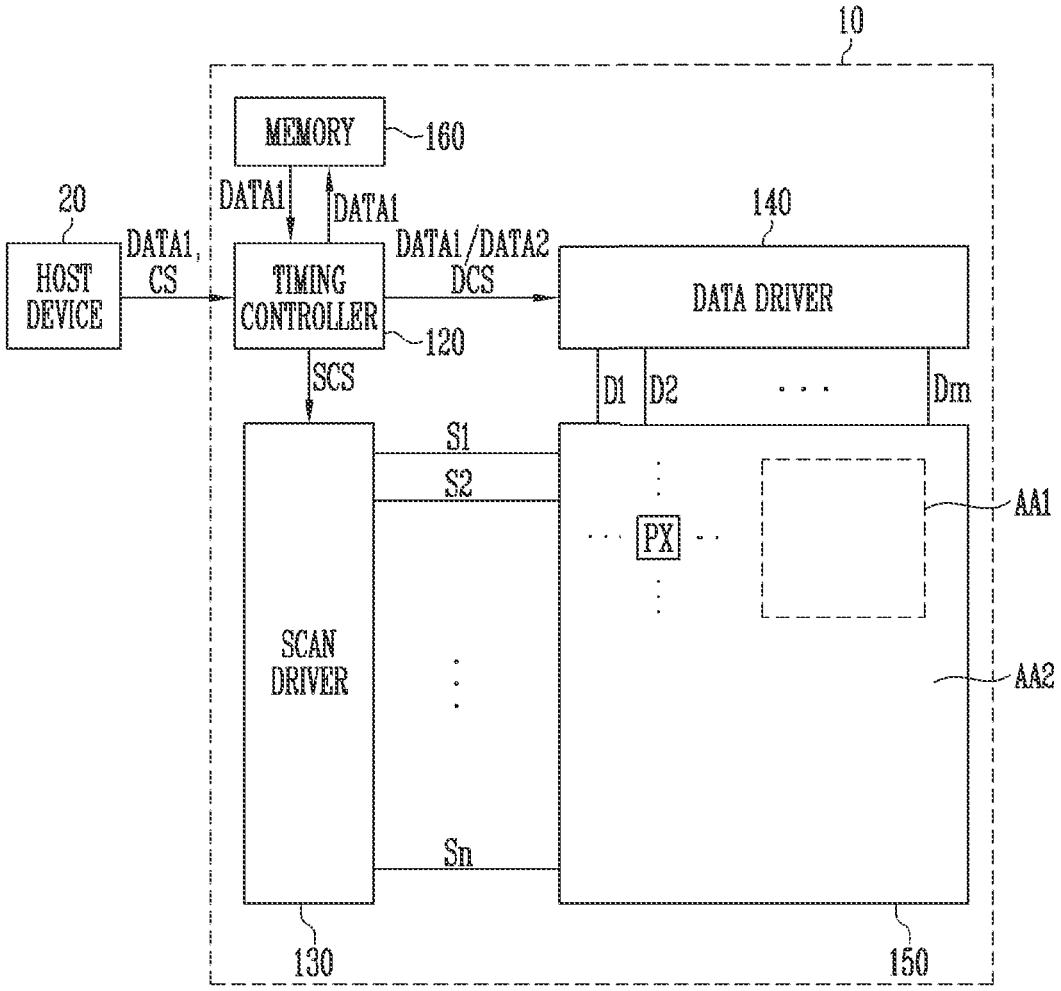
FIG. 1 is a block diagram of a display device according to some example embodiments of the present disclosure.

Hereinafter, aspects of some example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The display device or display devices and/or any other relevant devices or components, such a display panel including a plurality of pixels PX, a scan driver, a data driver, and a timing controller, according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
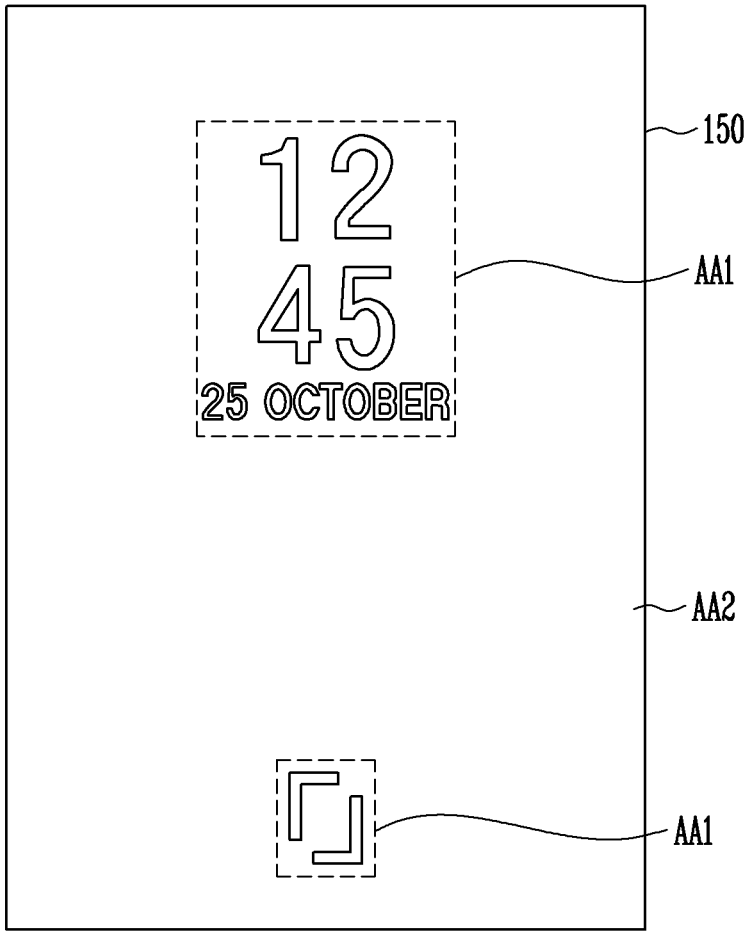
FIG. 2 is a view for explaining a display area according to some example embodiments of the present disclosure.

FIG. 1 is a block diagram of a display device according to some example embodiments of the present disclosure, and FIG. 2 is a view for explaining a display area according to some example embodiments of the present disclosure.

Referring to FIG. 1, a display device 10 may include a timing controller 120, a scan driver 130, a data driver 140, an image display unit 150, and memory 160.

The timing controller 120 may receive first image data DATA1 and a control signal CS from an external host device 20 and generate a scan control signal SCS and a data control signal DCS using the received control signal CS.

The host device 20 is arranged in order to control the operation of the display device 10, and may be implemented as, for example, an integrated circuit, a system on chip (SoC), an Application Processor (AP), or a mobile AP. The host device 20 may communicate with the display device 10 through a Mobile Industry Processor Interface (MIPI), but the technical spirit of the present disclosure is not limited thereto. In various embodiments, the host device 20 and the display device 10 may communicate with each other through various standard interfaces, such as a Mobile Display Digital Interface (MDDI), a display port, an embedded display port, and the like, as well as an MIPI.

The control signal CS may include a vertical synchronization signal, a horizontal synchronization signal, a data enable signal, a clock signal, and the like.

The timing controller 120 may receive the first image data DATA1 from the host device 20 at a frame rate (e.g., a predetermined frame rate). The first image data DATA1 may include image data for the first display area AA1 and the second display area AA2 of the image display unit (or image display) 150. Here, the frame rate (e.g., the predetermined frame rate) may correspond to periods at which at least one area of the image that is displayed in the image display unit 150, that is, the image to be displayed in the first display area AA1, is updated. For example, each period corresponding to the predetermined frame rate may be set so as to include multiple frames. The first image data DATA1 may include RGB values for the image to be displayed. For example, the first image data DATA1 may be 8-bit data.

According to some example embodiments of the present disclosure, the timing controller 120 may store the first image data DATA1 corresponding to the first display area AA1 of the image display unit 150 in the memory 160 with reference to the control signal CS. According to some example embodiments, the timing controller 120 may store the corresponding first image data DATA1 in the memory 160 after converting or downscaling the same. In such embodiments, the first image data DATA1 for the remaining area, excluding the first display area AA1 of the image display unit 150, that is, for the second display area AA2, is not stored in the memory 160.

Also, the timing controller 120 may load the first image data DATA1 for the first display area AA1 from the memory 160 on a frame basis during one period corresponding to the frame rate and transmit the same to the data driver 140. According to some example embodiments, the timing controller 120 may generate second image data DATA2 by upscaling the first image data DATA1 loaded from the memory 160 and transmit the second image data DATA2 to the data driver 140. Here, the timing controller 120 may generate image data for an image to be displayed in black for the second display area AA2 and the disabled first display area AA1 and transmit the generated image data to the data driver 140.

The timing controller 120 may transmit the scan control signal SCS to the scan driver 130. Also, the timing controller 120 may transmit the data control signal DCS and the first image data DATA1 or the second image data DATA2 to the data driver 140. For example, the timing controller 120 may transmit the second image data DATA2 to the data driver 140 when it generates the second image data DATA2 from the first image data DATA1, but may transmit the first image data DATA1 to the data driver 140 when it does not generate the second image data DATA2.

The scan driver 130 supplies scan signals to scan lines S1 to Sn in response to the scan control signal SCS.

The data driver 140 may generate a data signal using the data control signal DCS and the first image data DATA1 or the second image data DATA2 and transmit the data signal to data lines D1 to Dm.

The image display unit 150 may include pixels PX that display an image by being coupled to the scan lines S1 to Sn and the data lines D1 to Dm. Each of the pixels PX may be supplied with a data signal from the data lines D1 to Dm when a scan signal is supplied to the scan lines S1 to Sn, thereby emitting light with luminance corresponding to the data signal.

The image display unit 150 may be implemented as a light-emitting display panel, an organic light-emitting display panel, a liquid crystal display panel, a plasma display panel, or the like, but the image display unit 150 is not limited to these examples. Also, the image display unit 150 may be a hard-type display panel or a flexible-type display panel.

The memory 160 may store the first image data DATA1 under the control of the timing controller 120. According to some example embodiments, the first image data DATA1 corresponding to the first display area AA1 of the image display unit 150, that is, the first image data DATA1 for the image to be displayed in the first display area AA1, may be stored in the memory 160.

According to some example embodiments, the first image data DATA1 stored in the memory 160 may be the original first image data DATA1 received from the host device 20, that is, RGB values, or a grayscale value converted from the first image data DATA1. Also, the number of bits of the first image data DATA1 stored in the memory 160 may be equal to or less than the number of bits of the first image data DATA1 received from the host device 20.

Meanwhile, the memory 160 is illustrated as a component that is separate from the timing controller 120 in FIG. 1, but the technical spirit of the present disclosure is not limited thereto. According to some example embodiments, the memory 160 may be included in the timing controller 120.

Referring to FIG. 1 and FIG. 2, the image display unit 150 may include at least one first display area AA1 and a second display area AA2 according to some example embodiments of the present disclosure. The first display area AA1 may be an area in which an image is updated at a predetermined frame rate, and the second display area AA2 may be an area in which an image is not updated.

The first display area AA1 may be, for example, an area in which notification information is displayed in an Always on Display (AoD) mode or an area in which an emoticon, an icon, text, or the like is displayed on a background screen or an idle screen. Here, the notification information displayed in the AoD mode may include various types of notification information, such as a calendar, the date, the time, a home button area, a fingerprint recognition area, and the like. The second display area AA2 may be the remaining area, excluding the first display area AA1. For example, the second display area AA2 may be an area in which notification information, emoticons, icons, text, and the like are not displayed. However, the present disclosure is not limited to these examples.

According to some example embodiments of the present disclosure, the image display unit 150 may include multiple first display areas AA1.

In the embodiments described above, the control signal CS transmitted from the host device 20 to the timing controller 120 may include setting information for the first display area AA1 and/or the second display area AA2, enabling information for the first display area AA1, and a processing mode for the first display area AA1.

The setting information for the first display area AA1 may include coordinate information pertaining to the first display area AA1. For example, the setting information for the first display area AA1 may include information about the coordinates of at least one vertex of the first display area AA1 when the first display area AA1 is defined as a polygon. Alternatively, for example, the setting information for the first display area AA1 may include the length and the width starting from one point of the first display area AA1 when the first display area AA1 is defined as a rectangle. Alternatively, the setting information for the first display area AA1 may include the extent of the first display area AA1 based on a single reference point when the first display area AA1 is defined as an arbitrary figure. Alternatively, the setting information for the first display area AA1 may include information about the start pixel row, the end pixel row, the start pixel column, and the end pixel column of the first display area AA1. However, the setting information for the first display area AA1 is not limited to the above-described examples.

The enabling information for the first display area AA1 may be information for indicating whether the timing controller 120 stores the first image data DATA1 for the corresponding first display area AA1 in the memory 160, loads the same on a frame basis, and transmit the same to the data driver 140. For example, the first image data DATA1 of a first display area AA1 that is not enabled through the enabling information, among the multiple first display areas AA1, may not be stored in the memory 160. Accordingly, during the corresponding period, notification information (icons, emoticons, text or the like) may not be displayed in the first display area AA1 that is not enabled. Using the enabling information, only at least some of the multiple first display areas AA1 in the image display unit 150 may be selectively enabled or disabled. For example, the enabling information may be set to '1' for the first display area AA1 to be enabled, but may be set to '0' for the first display area AA1 to be disabled. Such enabling information may be transmitted to the timing controller 120 on a frame basis.

The processing mode for the first display area AA1 may be transmitted to the timing controller 120 in order to set the method for storing and displaying the first image data DATA1 for the first display area AA1. For example, the processing mode may include an RGB mode and a mono mode. For example, the processing mode may be set to '1' for the RGB mode, but may be set to '0' for the mono mode.

In the RGB mode, the timing controller 120 may store the RGB values of the first image data DATA1 for the first display area AA1 in the memory 160. In the mono mode, the timing controller 120 may convert the RGB values of the first image data DATA1 for the first display area AA1 into a grayscale value and store the grayscale value in the memory 160. The grayscale value may be derived from the RGB values using an arbitrary conversion equation. There is no limitation as to conversion equations or algorithms or mapping tables that are used for converting RGB values into a grayscale value.

Also, the processing mode for the first display area AA1 may include the number of bits as information for downscaling the first image data DATA1. In an embodiment, when each of the RGB values of the first image data DATA1 is configured with n bits, the number of bits included in the processing mode may be set to an arbitrary value, m, which ranges from 1 to n−1. When the processing mode is set to the RGB mode and when the number of bits is given, the timing controller 120 may extract as many bits as the given number from each of the RGB values and store the extracted bits in the memory 160. Also, when the processing mode is set to the mono mode and when the number of bits is given, the timing controller 120 may extract as many bits as the given number from the converted grayscale value and store the extracted bits in the memory 160. For example, when the number of bits is set to 1, the timing controller 120 may store the first bit of each of the RGB values or the first bit of the grayscale value in the memory 160. Alternatively, when the number of bits is set to 3, the timing controller 120 may store the first three bits of each of the RGB values or the first three bits of the grayscale value in the memory 160.

The processing mode for the first display area AA1 may be transmitted to the timing controller 120 in order to additionally set the method for displaying the first image data DATA1 for the first display area AA1. For example, when the number of bits of the first image data DATA1 to be stored is set using the processing mode and the first image data DATA1 is downscaled and stored based thereon, the method for upscaling the first image data DATA1 that is loaded from the memory 160 may be additionally set using the processing mode.

For example, when the first image data DATA1 is stored after being downscaled from n bits to m bits by setting the number of bits, the timing controller 120 may upscale the first image data DATA1, which is downscaled to m bits, to n-bit data by adding '0' or '1' thereto.

Alternatively, for example, the timing controller 120 may upscale the downscaled first image data DATA1 to n-bit data corresponding to a preset color. The color may be configured with a combination of one or more of white, red, green, blue, magenta, cyan, yellow, and black. Here, the timing controller 120 may generate n-bit data for representing a different color depending on the value of the downscaled first image data DATA1. This embodiment may be applied when the processing mode is set to the mono mode, but is not limited to the case in which the processing mode is set to the mono mode.

Alternatively, for example, the timing controller 120 may upscale the downscaled first image data DATA1 to n-bit data corresponding to a preset grayscale value. Here, the process of upscaling the downscaled first image data DATA1 to a grayscale value may be applied when the first image data DATA1, received from the host device 20, is downscaled to one bit and stored in the memory 160, but the present disclosure is not limited to this example. According to some example embodiments, the timing controller 120 may generate n-bit data having a different grayscale depending on the value of the downscaled first image data DATA1.

With regard to the first image data DATA1 received from the host device 20, the timing controller 120 may store only the first image data DATA1 for the first display area AA1 in the memory 160 based on the above-described control signal CS. Also, the timing controller 120 may load the first image data DATA1, which is stored for the first display area AA1, from the memory 160 and transmit the same to the data driver 140. Here, the timing controller 120 may generate image data in order to display a black image for the second display area AA2 and the disabled first display area AA1, and may transmit the generated image data to the data driver 140. However, the technical spirit of the present disclosure is not limited to this example. According to some example embodiments, the timing controller 120 may generate image data such that an arbitrary monochrome image is displayed in the second display area AA2 and transmit the generated image data to the data driver 140.

Generally, when the timing controller 120 stores the first image data DATA1 received from the host device 20 in the memory 160 and then loads and displays the first image data DATA1, the memory 160 may require a storage space having a capacity that is sufficient to store the first image data DATA1 corresponding to the resolution of the image display unit 150. However, in an embodiment of the present disclosure, because no notification information is displayed in the second display area AA2 and no update is performed therein as described above, storing the first image data DATA1 for the second display area AA2 may not be required. Also, the notification information displayed in the first display area AA1 may be relatively simple. In this case, when the notification information is displayed to a user, a large size of RGB values may not be required.

As described above, some example embodiments of the present disclosure may be configured such that, when the first image data DATA1 is stored in the memory 160, only the first image data DATA1 corresponding to the first display area AA1 is stored, and the first image data DATA1 is downscaled before being stored. Accordingly, the capacity of the storage space required for the memory 160 may be minimized or reduced. Also, the present disclosure is configured such that the first image data DATA1 stored in the memory 160 is displayed in the image display unit 150 after being upscaled depending on a different mode, whereby notification information may be displayed without data loss.

Hereinafter, the above-described technical features of some example embodiments of the present disclosure will be described in more detail.

Figure 3:
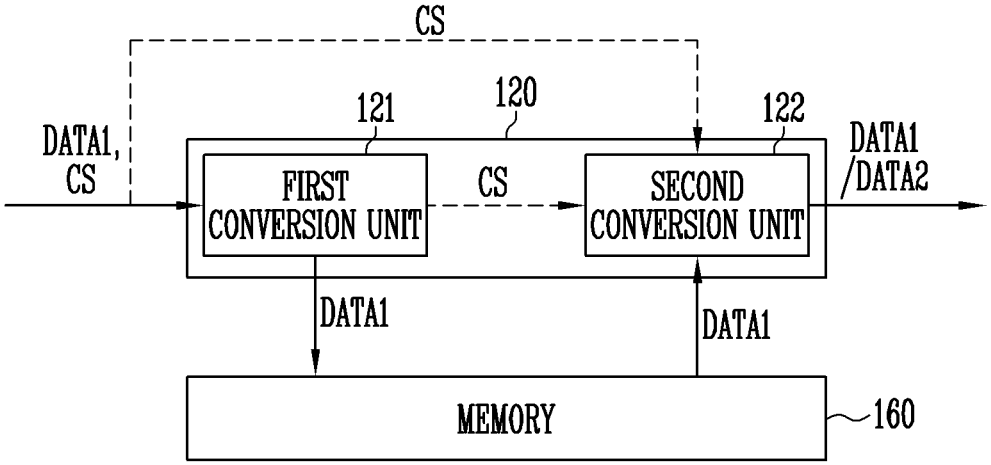
FIG. 3 is a block diagram specifically illustrating the timing controller and the memory of FIG. 1.

FIG. 3 is a block diagram that specifically shows the timing controller and the memory of FIG. 1.

Referring to FIGS. 1 to 3, the timing controller 120 may include a first conversion unit 121 and a second conversion unit 122.

The first conversion unit 121 may receive a control signal CS and first image data DATA1 from the host device 20. The first image data DATA1 may include RGB values for the image to be displayed, and may be, for example, 8-bit data.

The first conversion unit 121 may store the first image data DATA1 corresponding to the first display area AA1 in the memory 160 based on the setting information pertaining to the first display area AA1, which is included in the control signal CS. Here, the first conversion unit 121 may store only the first image data DATA1 of the enabled first display area AA1, among the multiple first display areas AA1, in the memory 160 based on the enabling information included in the control signal CS.

In response to the processing mode, which is set using the control signal CS, the first conversion unit 121 may store the original first image data DATA1, that is, the RGB values (in the RGB mode), or may convert the RGB values into a grayscale value and store the grayscale value (in the mono mode).

Also, in response to the processing mode, which is set using the control signal CS, the first conversion unit 121 may extract m bits from among n bits that configure each RGB value or a grayscale value and store the extracted bits in the memory 160. According to some example embodiments, the first conversion unit 121 may extract only upper m bits from among n bits that configure each RGB value or a grayscale value and store the extracted bits in the memory 160.

For example, when the RGB values of the first image data DATA1 for an arbitrary pixel in the first display area AA1 are R='10010100', G='11111111', and B='01111111', when the processing mode is the RGB mode, and when the number of bits is set to 3, the first conversion unit 121 may store the upper 3 bits of each of the RGB values, which are R='100', G='111', and B='011', in the memory 160. Also, when the processing mode is the mono mode, when the grayscale value converted from the RGB values of the first image data DATA1 is '00111110', and when the number of bits is set to 3, the first conversion unit 121 may store the upper 3 bits of the converted grayscale value, which is '001', in the memory 160.

According to some example embodiments, the first conversion unit 121 may further compress the first image data DATA1 based on a general data compression method and store the compressed first image data DATA1 in the memory 160. Accordingly, the storage capacity of the memory 160 required for storing the first image data DATA1 may be further reduced.

The second conversion unit 122 may receive a control signal CS from the host device 20 or the first conversion unit 121. The second conversion unit 122 may load the first image data DATA1 from the memory 160 at each frame.

The second conversion unit 122 may transmit the first image data DATA1 to the data driver 140 without change. For example, when the original first image data DATA1 is stored without being converted or downscaled by the first conversion unit 121, the second conversion unit 122 may transmit the first image data DATA1 to the data driver 140 without change.

According to some example embodiments, the second conversion unit 122 may generate second image data DATA2 by upscaling the first image data DATA1 and transmit the second image data DATA2 to the data driver 140. In such embodiments, the second conversion unit 122 may generate the second image data DATA2 from the first image data DATA1 in response to the processing mode, which is set using the control signal CS.

For example, the second conversion unit 122 may generate second image data DATA2 that is upscaled to n-bit data by adding n-m bits to the first image data DATA1 that is downscaled to m-bit data. For example, the second conversion unit 122 adds (n-m) '0's or '1's to the m-bit first image data DATA1 as the lower bits thereof, thereby generating second image data DATA2. For example, when the first image data DATA1, which is downscaled to three bits, is '001', the second conversion unit 122 may generate second image data DATA2 having a value of '00100000' or '00111111'. However, the technical spirit of the present disclosure is not limited to these examples. According to some example embodiments, the second conversion unit 122 may generate lower bits using an arbitrary algorithm and generate second image data DATA2 using the generated lower bits. There is no limitation as to a method for generating lower bits for upscaling.

Alternatively, for example, the second conversion unit 122 may generate second image data DATA2 by upscaling the first image data DATA1, which is downscaled to m bits, to n-bit data corresponding to preset color information. In this embodiment, the color may be configured with a combination of one or more of white, red, green, blue, magenta, cyan, yellow, and black.

In such embodiments, the second conversion unit 122 may generate second image data DATA2 having a different color corresponding to the value of the first image data DATA1, which is downscaled to m bits. For example, when the first image data DATA1 that is downscaled to one bit is '0', the second conversion unit 122 may generate 8-bit second image data DATA2 (e.g., '00000000') corresponding to a black color. When the first image data DATA1 downscaled to one bit is '1', the second conversion unit 122 may generate 8-bit second image data DATA2 (e.g., '11111111') corresponding to a white color.

Such embodiments may be applied when the processing mode is set to the mono mode, but is not limited to the case in which the processing mode is set to the mono mode.

Alternatively, for example, the second conversion unit 122 may upscale the first image data DATA1, which is downscaled to m bits, to n-bit data corresponding to a preset grayscale value. According to some example embodiments, the second conversion unit 122 may generate second image data DATA2 having a different grayscale corresponding to the value of the first image data DATA1, which is downscaled to m bits. For example, when the first image data DATA1 downscaled to one bit is '0', the second conversion unit 122 may generate 8-bit second image data DATA2 corresponding to a first grayscale. When the first image data DATA1 downscaled to one bit is '1', the second conversion unit 122 may generate 8-bit second image data DATA2 corresponding to a second grayscale.

Such embodiments may be applied to the case in which the number of bits set using the processing mode is 1, but is not limited to the corresponding case.

According to some example embodiments of the present disclosure, the second conversion unit 122 may transmit the first image data DATA1 or the second image data DATA2 to the data driver 140 in order to display the same in the first display area AA1 of the image display unit 150. The second conversion unit 122 may generate image data in order to display an arbitrary monochrome image in the second display area AA2 of the image display unit 150 and transmit the generated image data to the data driver 140. For example, the second conversion unit 122 may generate image data in order to display a black color in the second display area AA2 and the disabled first display area AA1, and may transmit the generated image data to the data driver 140.

According to some example embodiments of the present disclosure, the second conversion unit 122 may shift the position of the first display area AA1 at preset intervals. For example, the second conversion unit 122 may shift the position at which the first image data DATA1 or the second image data DATA2 is to be displayed at preset intervals and transmit the position to the data driver 140. According to such an embodiment, the deterioration of pixels PX, which may be caused by displaying the same image for a long time, may be prevented.

Figure 4:
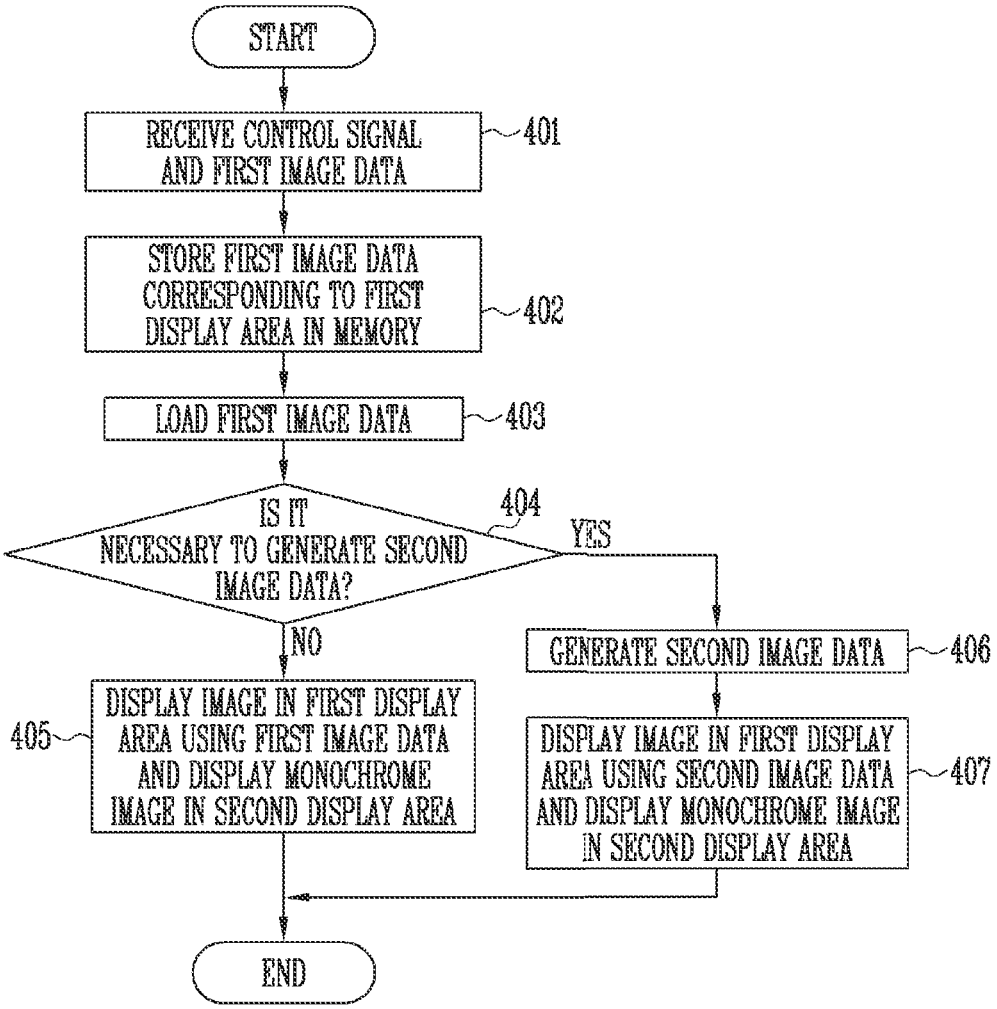
FIG. 4 is a flowchart illustrating the driving method of a display device according to some example embodiments of the present disclosure.
Figure 9:
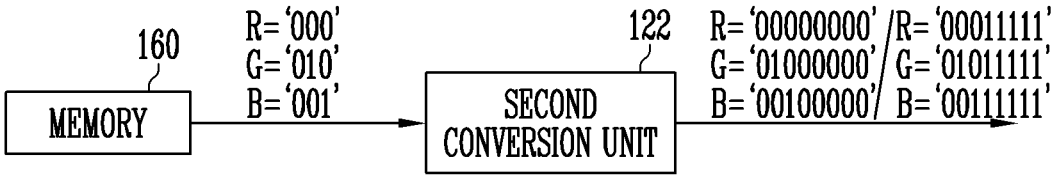
FIGS. 9 to 11 are views for explaining a method for generating second image data according to some example embodiments of the present disclosure.
Figure 10:
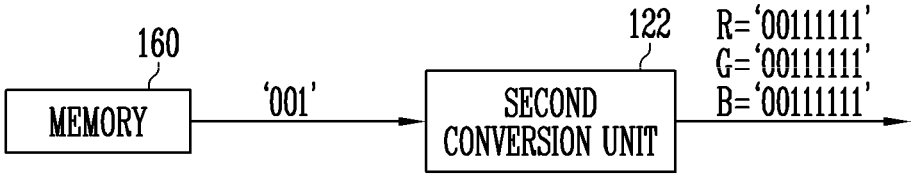
Figure 11:
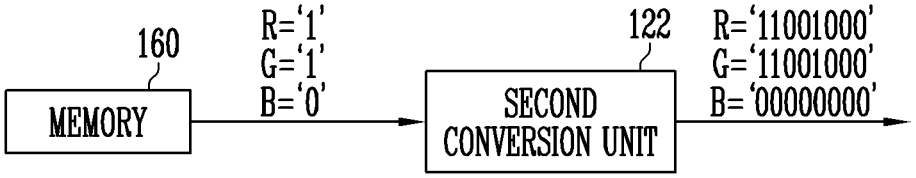

FIG. 4 is a flowchart that shows the driving method of a display device according to some example embodiments of the present disclosure. Also, FIGS. 5 to 8 are views for explaining a method for storing first image data according to various embodiments of the present disclosure, and FIGS. 9 to 11 are views for explaining a method for generating second image data according to some example embodiments of the present disclosure.

Referring to FIGS. 1 to 4, the display device 10 according to some example embodiments of the present disclosure may operate in the driving state based on a power-on signal or the like supplied from the outside.

The display device 10 may receive a control signal CS and first image data DATA1 from the host device 20 at step 401. The control signal CS received from the host device 20 may include setting information pertaining to the first display area AA1 and/or the second display area AA2, enabling information pertaining to the first display area AA1, a storage mode for the first display area AA1, and a display mode for the first display area AA1.

Based on the control signal CS, the display device 10 may store the first image data DATA1 corresponding to the first display area AA1 in the memory at step 402. When multiple first display areas AA1 are set depending on the control signal CS, the display device 10 may store the first image data DATA1 only for the first display area AA1 that is enabled through the enabling information of the control signal CS.

The display device 10 may store the RGB values of the first image data DATA1 or a grayscale value, which is converted from the RGB values, in the memory 160 depending on the processing mode set using the control signal CS. Also, the display device 10 may downscale the first image data DATA1 depending on the number of bits, which is additionally set in the processing mode, and store the downscaled first image data DATA1 in the memory 160.

Figure 5:
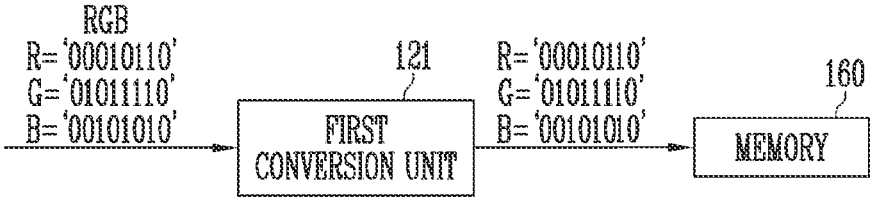
FIGS. 5 to 8 are views for explaining a method for storing first image data according to some example embodiments of the present disclosure.
Figure 6:
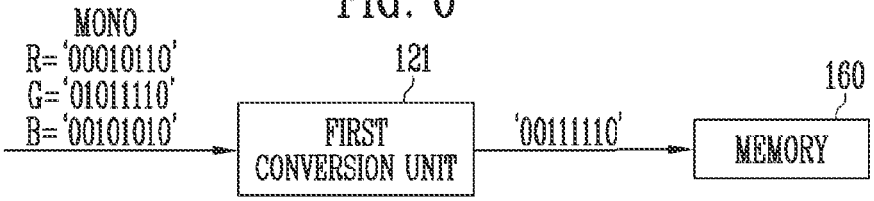

For example, referring to FIGS. 5 to 8, according to some example embodiments, the first image data DATA1 may be data in which R, G and B values, each of which ranges from 0 to 255, are represented as 8-bit binary numbers. In the embodiments of FIGS. 5 to 6, for example, the R, G and B values of the first image data DATA1 may be '00010110', '01011110' and '00101010', respectively.

When the processing mode is set to an RGB mode and when there is no limitation as to the number of bits, the first conversion unit 121 may store the 8-bit R, G and B values of the first image data DATA1 in the memory 160 without change, as shown in FIG. 5.

When the processing mode is set to a mono mode and when there is no limitation as to the number of bits, the first conversion unit 121 may derive a 8-bit grayscale value from the R, G and B values of the first image data DATA1 using an arbitrary conversion equation or algorithm, a mapping table, or the like. For example, the first conversion unit 121 may set the mean of the R, G and B values as the 8-bit grayscale value. As shown in FIG. 6, the first conversion unit 121 may store the converted grayscale value in the memory 160. According to some example embodiments, as illustrated in FIG. 6, the converted grayscale value may be '00111110'.

Figure 7:
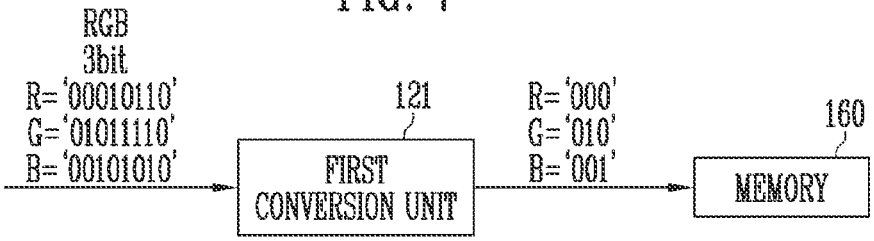
Figure 8:
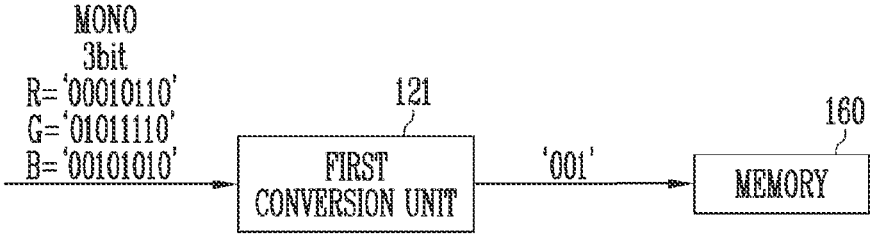

Meanwhile, when the number of bits is limited through the processing mode, the first conversion unit 121 may downscale the first image data DATA1 and store the downscaled first image data DATA1 in the memory 160, as shown in FIG. 7 and FIG. 8. For example, when the processing mode is set to the RGB mode and when the number of bits is limited to 3, the first conversion unit 121 may extract the upper 3 bits from each of the R, G and B values of the first image data DATA1 and store the extracted bits in the memory 160, as shown in FIG. 7.

When the processing mode is set to the mono mode and when the number of bits is limited to 3, the first conversion unit 121 may extract upper 3 bits from the converted grayscale value of the first image data DATA1 and store the extracted bits in the memory 160, as shown in FIG. 8.

The display device 10 may load the first image data DATA1 from the memory 160 at step 403. The display device 10 may load the first image data DATA1 on a frame basis. For example, before it receives new first image data DATA1 from the host device 20, the display device 10 may load the first image data DATA1 from the memory 160.

According to some example embodiments, the display device 10 may determine whether it is necessary to generate second image data DATA2 based on the control signal CS at step 404. For example, based on the processing mode set using the control signal CS, the display device 10 may determine whether it is necessary to generate second image data DATA2. According to some example embodiments, when the processing mode is the RGB mode and when the number of bits is not limited through the processing mode, the display device 10 may determine that it is not necessary to generate second image data DATA2. Also, when the number of bits of the storage mode is limited, the display device 10 may determine that it is necessary to generate second image data DATA2.

When it is determined that it is not necessary to generate second image data DATA2, the display device 10 may display an image in the first image area AA1 using the loaded first image data DATA1 at step 405. Here, the display device 10 may display a preset monochrome image in the second display area AA2 and the disabled first display area AA1.

When it is determined that is necessary to generate second image data DATA2, the display device 10 may generate second image data DATA2 at step 406 by upscaling the loaded first image data DATA1. The display device 10 may upscale the first image data DATA1 depending on the display mode, which is set using the control signal CS.

For example, referring to FIG. 9, the R, G and B values of the loaded first image data DATA1, of which the number of bits is limited to three bits in the RGB mode, may be '000', '010' and '001', respectively. The second conversion unit 122 sets each of R, G and B values as eight bits by adding lower 5 bits configured with '0's or '1's to each of the R, G and B values of the first image data DATA1, as shown in FIG. 9, thereby generating second image data DATA2 having the set RGB values.

Referring to FIG. 10, the loaded first image data DATA1, of which the number of bits is limited to three bits in the mono mode, may be '001'. According to some example embodiments, the second conversion unit 122 may generate 8-bit second image data DATA2 for displaying an arbitrary color that is preset to correspond to the value of the loaded first image data DATA1, as shown in FIG. 10. The arbitrary color may be configured with a combination of one or more of white, red, green, blue, magenta, cyan, yellow and black.

FIG. 10 illustrates an example in which second image data DATA2, of which the R, G and B values are R='00111111', G='00111111', and B='00111111' that represent a white color, is generated so as to correspond to '001', which is the value of the loaded first image data DATA1. Meanwhile, in various embodiments of the present disclosure, second image data DATA2 may be generated so as to represent a color other than the white color. For example, second image data DATA2 may be generated so as to have values of R='00111111', G='00000000', and B='00000000' that represent a red color.

When the processing mode is the RGB mode, the above-described method for generating second image data DATA2 may cause image confusion by changing the original RGB color. Accordingly, such embodiments may be applied when the processing mode is a mono mode. However, the present disclosure is not limited thereto.

Referring to FIG. 11, the R, G and B values of the loaded first image data DATA1, of which the number of bits is limited to one bit in the RGB mode, may be '1', '1', and '0', respectively. According to some example embodiments, the second conversion unit 122 may generate 8-bit second image data DATA2 for displaying an arbitrary color having an arbitrary grayscale, which is preset to correspond to the value of the loaded first image data DATA1, as shown in FIG. 11. FIG. 11 illustrates an example in which second image data DATA2 having values of R='11001000', G='11001000', and B='00000000' that represent an arbitrary color (e.g., yellow) having a first grayscale (e.g., 200 grayscales) is generated so as to correspond to '110', which is the value of the loaded first image data DATA1. Meanwhile, in various embodiments of the present disclosure, when the value of the loaded first image data DATA1 is different from the value illustrated in FIG. 11, second image data DATA2 may be generated so as to have a value that represents a second grayscale, which is different from the first grayscale.

The second conversion unit 122 may display an image in the first display area AA1 using the generated second image data DATA2 at step 407. Here, the display device 10 may display a preset monochrome image in the second display area AA2 and the disabled first display area AA1.

FIGS. 12 to 15 are views for explaining various embodiments of the driving method of a display device according to the present disclosure.

According to some example embodiments of the present disclosure, the display device 10 may be driven depending on two or more of the above-described setting modes. That is, the setting mode may be set differently for the multiple first display areas AA1 in the display device 10. FIGS. 12 to 15 show examples of images displayed in the first display area AA1 when the setting modes are set differently for the multiple first display areas AA1.

Figure 12:
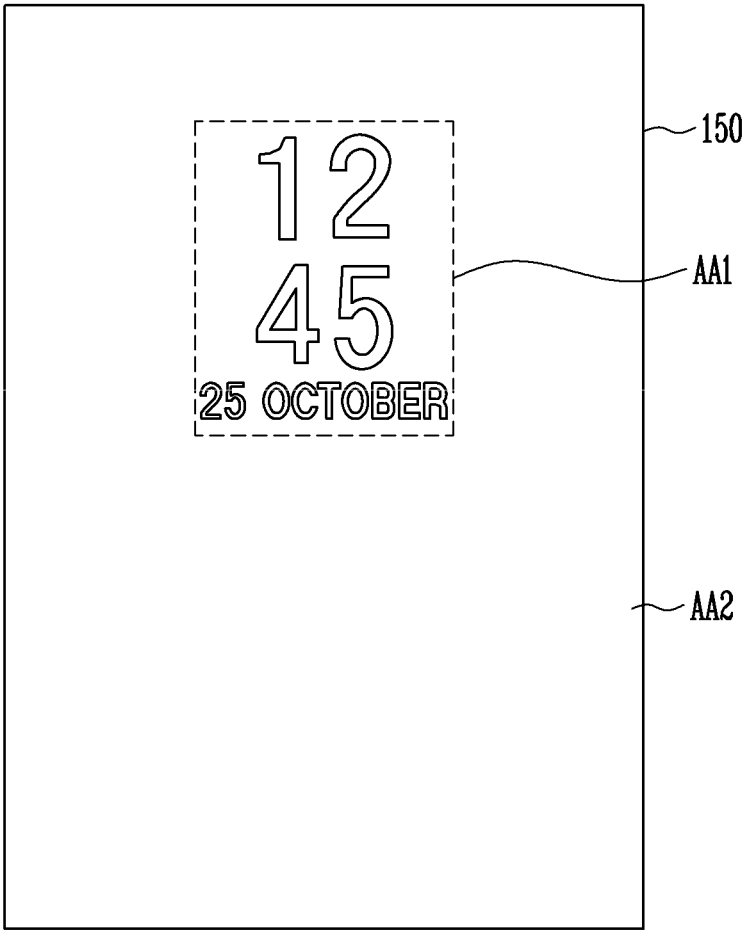
FIGS. 12 to 15 are views for explaining various embodiments of the driving method of a display device according to some example embodiments of the present disclosure.

According to some example embodiments, as illustrated in FIG. 12, the display device 10 may include a single first display area AA1. Here, the setting mode for the first display area AA1 is set to an RGB mode, and the number of bits is limited to one bit. Here, the downscaled image data is set to be upscaled based on a grayscale value of 255. According to some example embodiments, as shown in FIG. 12, the maximum size of the storage space required for the memory 160 of the display device 10 is 1,360,800 bits. This storage space size is merely an embodiment, and the illustrated size of the storage space may vary depending on the resolution of the display device 10 and the size of the first display area AA1.

Figure 13:
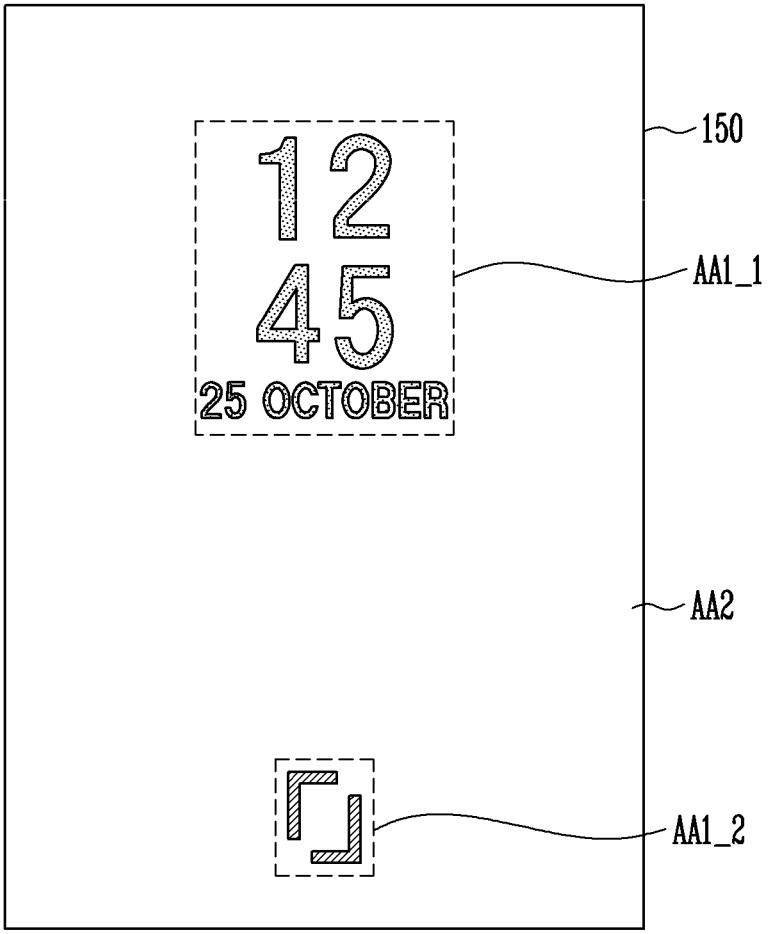

According to some example embodiments, as illustrated in FIG. 13, the display device 10 may include two first display areas AA1_1 and AA1_2. Here, the processing mode for the first display areas AA1_1 and AA1_2 is set to a mono mode, and the number of bits is limited to one bit. Also, the downscaled image data may be set to be upscaled based on an arbitrary grayscale value. Here, the grayscale value for any one (AA1_1) of the first display areas AA1_1 and AA1_2 may be set to 255, and the grayscale value for the other one may be set to 127. According to some example embodiments, as illustrated in FIG. 13, the maximum size of the storage space required for one of the first display areas AA1_1 and AA1_2 may be 680,400 bits, and the maximum size of the storage space required for the other one may be 68,040 bits. Accordingly, the maximum size of the storage space required for the memory 160 of the display device 10 is 748,440 bits. This storage space size is merely an embodiment, and the illustrated sizes of the storage spaces may vary depending on the resolution of the display device 10 and the sizes of the first display areas AA1_1 and AA1_2.

Meanwhile, according to some example embodiments, as illustrated in FIG. 13, the processing mode for any one of the first display areas AA1_1 and AA1_2 may be set to the mono mode, and the number of bits may be limited to one bit. Also, the image data downscaled for the corresponding first display area may be set to be upscaled based on a yellow color. Also, the processing mode for the other one of the first display areas AA1_1 and AA1_2 may be set to the RGB mode, and the number of bits may be limited to three bits. Also, the image data downscaled for the corresponding display area may be set to be upscaled based on a yellow color. According to some example embodiments, as illustrated in FIG. 13, the maximum size of the storage space required for any one of the first display areas AA1_1 and AA1_2 is 680,400 bits, and the maximum size of the storage space required for the other one is 612,360 bits. Accordingly, the maximum size of the storage space required for the memory 160 of the display device 10 is 1,292,760 bits. This storage space size is merely an embodiment, and the illustrated sizes of the storage spaces may vary depending on the resolution of the display device 10 and the sizes of the first display areas AA1_1 and AA1_2.

Figure 14:
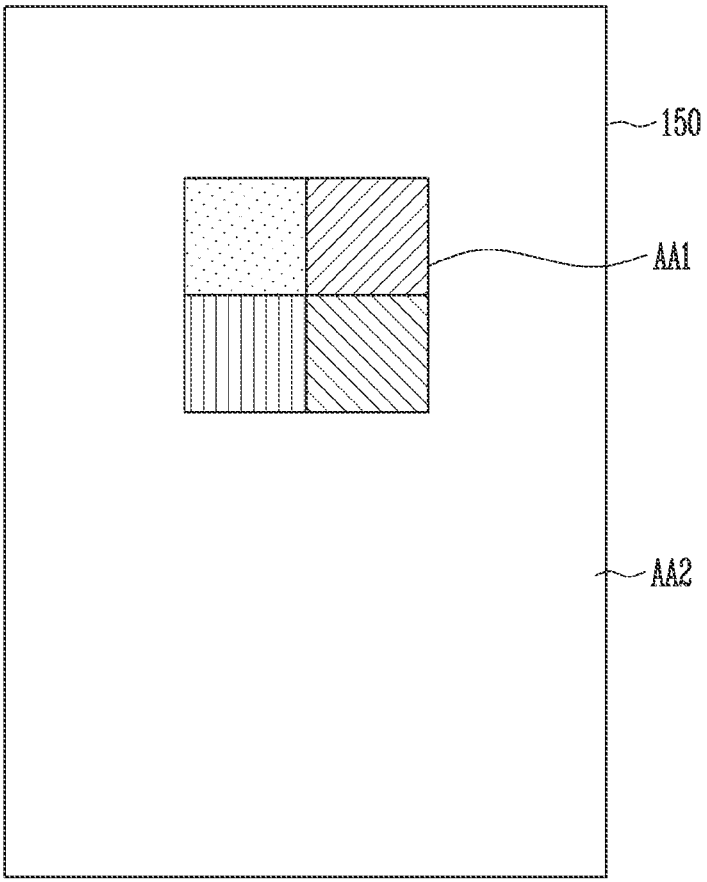
Figure 15:
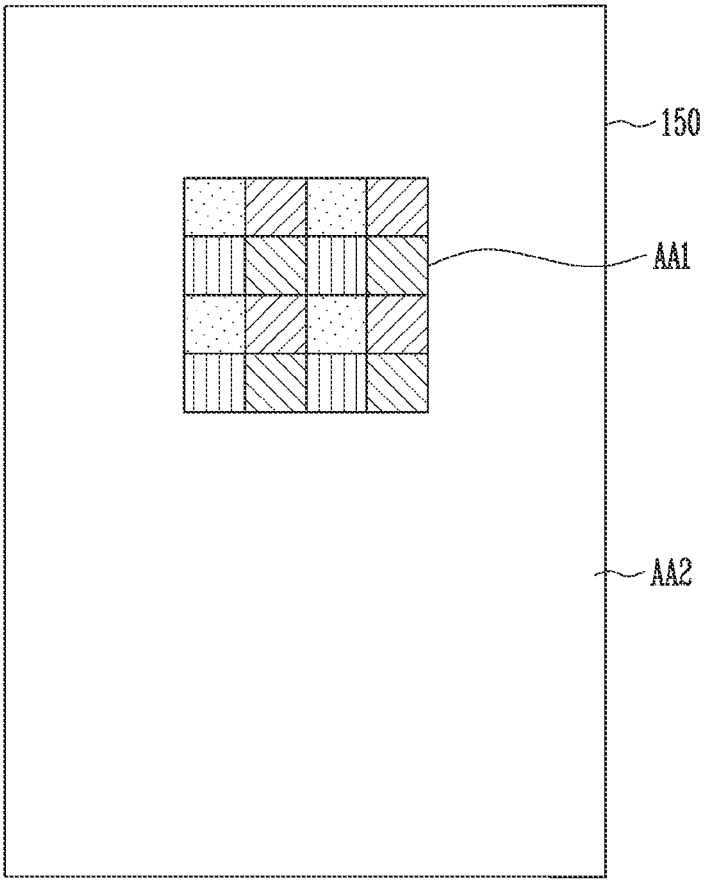

According to some example embodiments, as illustrated in FIG. 14 and FIG. 15, the display device 10 includes a single first display area AA1. Here, the setting mode for the first display area AA1 may be set to the RGB mode, and the downscaled image data may be set to be upscaled using lower bits configured with '0's or '1's. The number of bits for the first display area AA1 in the embodiment of FIG. 14 and the number of bits for the first display area AA1 in the embodiment of FIG. 15 may be limited to one bit and two bits, respectively.

Because the number of bits to be stored in the memory 160 is limited through a storage mode, the size of the storage space required in the embodiment of FIG. 14 is different from that required in the embodiment of FIG. 15. Specifically, as the limited number of bits is smaller, the required size of the storage space may be reduced. For example, the maximum size of the storage space required in the embodiment of FIG. 14 may be 1,224,720 bits, and the maximum size of the storage space required in the embodiment of FIG. 15 may be 1,306,368 bits.

Meanwhile, as the number of bits limited through the storage mode is smaller, the resolution of the image displayed in the first display area AA1 is decreased. In the embodiments of FIG. 14 and FIG. 15, the resolution of the image displayed in the first display area AA1 in the embodiment of FIG. 14, in which the number of bits is limited to one bit, is lower than that in the embodiment of FIG. 15.

As described above, because the image displayed in the first display area AA1 includes only a relatively simple image such as notification information, the loss of the resolution is not a problem. According to some example embodiments, the storage mode may be appropriately selected in consideration of the image to be displayed in the first display area AA1, the size of the memory 160, the manufacturing cost of the display device 10, and the like.

As described above, the present disclosure is configured to drive the display device 10 depending on various setting modes, and the size of the storage space of the memory 160 may be controlled adaptively based on the setting mode.

A display device and a driving method thereof according to the present disclosure may reduce the capacity of a storage space required in order for the display device to display an image, in which a specific area is periodically updated, thereby reducing the size of the display device.

Also, a display device and a driving method thereof according to some example embodiments of the present disclosure may reduce the total cost of a product by improving the usage efficiency of the storage space thereof.

Those skilled in the art may understand that the present disclosure can be implemented in other specific forms without changing the technical spirit or essential features of the present disclosure. Therefore, it should be noted that the forgoing embodiments are merely illustrative in all aspects and are not to be construed as limiting the present disclosure. The scope of the present disclosure is defined by the appended claims rather than the detailed description of the present disclosure. All changes or modifications or their equivalents made within the meanings and scope of the claims should be construed as falling within the scope of the present disclosure.

What is claimed is:

1. A display device, comprising:

an image display having at least one first display area and a second display area;

a memory configured to store image data; and a timing controller configured to store first image data for the first display area in the memory after first image data for the first display area and the second display area is received from a host device, wherein the timing controller is configured to control the image display so as to display a first image in the first display area by loading the first image data for the first display area from the memory and to display a preset second image in the second display area, and wherein, in a first processing mode, the timing controller is configured to store RGB values of the first image data in the memory, and in a second processing mode, the timing controller is configured to convert the RGB values of the first image data of the first display area into a single grayscale value and to store the grayscale value in the memory, wherein, in the second processing mode, the timing controller is configured to generate downscaled first image data by downscaling n-bit RGB values of the first image data of the first display area or an n-bit grayscale value, which is converted from the RGB values, to m-bit data and to store the downscaled first image data in the memory, n being a natural number that is greater than 2 and m being a natural number that ranges from 1 to n−1, and wherein, in the second processing mode, the timing controller is configured to generate second image data by adding n-m bits to the downscaled first image data, and all of the n-m bits are '0's or '1's.

2. The display device according to claim 1, wherein the timing controller is configured to store the first image data for an enabled first display area, among the at least one first display area, in the memory based on enabling information received from the host device.

3. The display device according to claim 1, wherein, in the second processing mode, the timing controller is configured to display the first image in the first display area so as to correspond to the second image data.

4. The display device according to claim 3, wherein, in the second processing mode, the timing controller is configured to determine a color, which is preset to correspond to the downscaled first image data, and to generate n-bit second image data corresponding to the determined color, m being a natural number that ranges from 1 to n−1, in response to the n-bit grayscale value, which is converted from the RGB values, being downscaled to the m-bit data and then being stored in the memory,.

5. The display device according to claim 3, wherein, in the second processing mode, the timing controller is configured to determine a grayscale, which is preset to correspond to the downscaled first image data, and to generate n-bit second image data corresponding to the determined grayscale, when the first image data is downscaled to 1-bit data and is then stored in the memory.

6. The display device according to claim 1, wherein the second image is a black image.

7. A driving method of a display device, comprising:

receiving a control signal and first image data for at least one first display area and a second display area from a host device;

storing first image data for the first display area;

displaying a first image in the first display area by loading the first image data; and displaying a preset second image in the second display area, wherein storing the first image data for the first display area comprises, in a first mode, storing RGB values of the first image data, and, in a second mode, converting the RGB values of the first image data into a single grayscale value and storing the first image data that is converted into the grayscale value, wherein, in the second mode, storing the first image data for the first display area comprises:

downscaling n-bit RGB values of the first image data or an n-bit grayscale value, which is converted from the RGB values, to m-bit data, n being a natural number that is greater than 2 and m being a natural number that ranges from 1 to n−1; and storing the downscaled first image data, and wherein, in the second mode, generating the second image data comprises:

adding n-m bits to the downscaled first image data, and all of the n-m bits are '0's or '1's.

8. The driving method according to claim 7, wherein storing the first image data for the first display area comprises:

determining an enabled first display area, among the at least one first display area, based on enabling information of the control signal; and storing the first image data for the enabled first display area.

9. The driving method according to claim 7, wherein displaying the first image in the first display area by loading the first image data and displaying the preset second image in the second display area comprises:

displaying the first image in the first display area so as to correspond to the second image data.

10. The driving method according to claim 9, wherein, in the second mode, generating the second image data comprises:

after the n-bit grayscale value, which is converted from the RGB values, is downscaled to the m-bit data and is then stored, determining a color, which is preset to correspond to the downscaled first image data, m being a natural number that ranges from 1 to n−1; and generating n-bit second image data corresponding to the determined color.

11. The driving method according to claim 9, wherein, in the second mode, generating the second image data comprises:

after the first image data is downscaled to 1-bit data and is then stored, determining a grayscale, which is preset to correspond to the downscaled first image data; and generating n-bit second image data corresponding to the determined grayscale.

12. The driving method according to claim 7, wherein the second image is a black image.

* * * * *